US005395454A

United States Patent [19]

Robert

[11] Patent Number: 5,395,454

[45] Date of Patent: Mar. 7, 1995

[54] A METHOD OF CLEANING ELONGATED OBJECTS

[75] Inventor: Marc J. Robert, Tokyo, Japan

[73] Assignee: Liquid Air Corporation, Walnut Creek, Calif.

[21] Appl. No.: 163,710

[22] Filed: Dec. 9, 1993

[51] Int. Cl.[6] ..... B08B 5/00; B08B 7/00

[52] U.S. Cl. ..... 134/6; 134/7; 134/9; 134/15

[58] Field of Search ..... 134/15, 6, 7, 9

[56] References Cited

U.S. PATENT DOCUMENTS

| | | | |
|---|---|---|---|
| 1,993,400 | 3/1935 | Convers | 148/20 |
| 4,551,180 | 11/1985 | Gough | 134/9 |
| 5,147,466 | 9/1992 | Ohmori et al. | 134/7 |
| 5,209,028 | 5/1993 | McDermott et al. | 134/7 |
| 5,294,261 | 3/1994 | McDermott et al. | 134/7 |

FOREIGN PATENT DOCUMENTS 0474345 8/1990 European Pat. Off. .

*Primary Examiner*—Richard O. Dean
*Assistant Examiner*—Zeinab El-Arini
*Attorney, Agent, or Firm*—Oblon, Spivak, McClelland, Maier & Neustadt

[57] ABSTRACT

Method and apparatus for cleaning elongated objects of surface contaminants. The elongated objects are exposed to a liquid or solid inert gas at suitable quantities to embrittle the contaminants. The elongated objects are then drawn through a die orifice causing the embrittled surface contaminants to be removed from the elongated objects.

13 Claims, 3 Drawing Sheets

A METHOD OF CLEANING ELONGATED OBJECTS

TECHNICAL FIELD OF THE INVENTION

The present invention deals with a method and device for cleaning elongated objects of surface contaminants. This invention eliminates the need to provide pickling solutions of various acids and/or solvents and/or ultrasound cleaning systems thus providing for the cleaning of elongated objects in a more environmentally favored system than heretofore thought possible.

BACKGROUND OF THE INVENTION

Elongated objects such as wires, rods and tubular or flat shapes (such as tubing, strip, plates, etc.) are oftentimes contaminated with undesirable surface coatings. In the case of steel wires, manufacturing often results in the formation on their surface of oxides, including rust or impurities such as dirt particles, lubricant and compound residues, etcetera.

In the case of copper wires, exposure to the environment results in copper oxidation in the form of a surface scale which consists of a mixture of cuprous (red) and cupric (black) oxides. Such oxidation layer needs to be removed from the copper surface because it greatly reduces the strength of the copper wire and its ability to withstand further processing.

There have been a number of techniques suggested by the prior art to remove surface contamination. For example, U.S. Pat. No. 1,993,400 teaches various methods for annealing and oxidizing a wire to remove known and unknown soap or grease compounds used in drawing the wire to size, by passing electric current through the wire to heat it. The book entitled "Ferrous Wire", vol. 1, chapter 6—Chemical Cleaning and Coating, published by the Wire Association International Inc., discloses various methods to clean ferrous wires, such as pickling, ultrasonic cleaning, etcetera. Batch pickling still remains the most commonly used cleaning method in the wire industry to remove surface contaminants. In this method, baths of either sulfuric or hydrochloric acid are placed in line in such a manner that the material may be dipped in acid tanks, rinse tanks, lime, borax and finally baked before passing the metal onto the wire mill itself.

Although it has been suggested, e.g., in U.S. Pat. No. 4,401,479, that ultrasonic cleaning can be employed to remove surface contaminants, apart from specialized one-wire systems, ultrasonic cleaning in standard tanks is seldom used for wire, since the energy concentration is usually too low for one-pass continuous-line systems.

Flash pickling is also disclosed in this patent. However, flash pickling unfortunately produces fumes and strong acid carryover. As a result, hazardous and environmentally damaging effluents are an important concern for this type of industry. The earliest treatment for effluents was to direct the spent acids to a nearby stream resulting in acid pollution, aeration and the precipitation of offensive metal salts. Large quantities of acids and alkalis cannot obviously be disposed of because of their influence on the environment. Treatment in some fashion, therefore, becomes necessary. Most countries have laws precluding stream pollution by acids, alkalis and metals. To cope with this situation, a number of alternative schemes have been proposed such as ponding, deep well disposal, neutralization with alkali, ammonia or slag, sulfuric acid recovery by cooling saturated solutions and hydrochloric acid recovery by roasting. None of these approaches completely address the environmental hazards. In addition, sophisticated solutions are costly.

U.S. Pat. No. 4,064,884 discloses a method and device to clean the surface of, e.g., a wire, by washing said surface with a washing liquid which is substantially the same kind as the one used in the last surface treatment step of said surface. U.S. Pat. No. 4,401,479 discloses a process of ultrasonic cleaning in a liquid to clean the surface of a wire and catalyze the rusting chemical reactions in order to use the wire in a concrete structure. U.S. Pat. No. 4,713,153 discloses a process and apparatus for cleaning by electrochemical pickling. U.S. Pat. No. 4,754,803 also discloses chemical pickling of copper rods. U.S. Pat. No. 4,899,798 discloses the recovery and the reuse of organic pickling vapors in copper bar and rod manufacture. U.S. Pat. No. 4,944,808 discloses a method to remove particles from a flexible support, much as a flexible sheet. European Patent 474,345 discloses a method to remove particulate matters from articles by the use of a liquid cryogen in which the articles are totally immersed in the liquid cryogen. As the articles are supported while immersed, the particles fall at the bottom of the cryogenic liquid bath, and the articles are further removed.

SUMMARY OF THE INVENTION

Thus, it is an object of the present invention to provide a method for cleaning elongated objects such as wires and rods of surface contamination while avoiding environmental pollution.

It is yet a further object of the present invention to provide a method of cleaning elongated objects such as wires and rods without the need for solvents and/or acidic or alkali pickling solutions commonly used by the prior art.

According to the invention, it is provided a method of cleaning elongated objects of surface contaminants as well as a device for carrying out this method, wherein elongated objects such as wires or rods are exposed to a cold liquid or a cold solid inert gas or a cold gas (gaseous) such as nitrogen (liquid or liquid/gas or gas) or carbon dioxide (snow or pellets or cold $CO_2$ gas) which causes the surface contaminants to become brittle. The elongated objects are then drawn through an orifice such as a die orifice causing the embrittled surface contaminants to be removed therefrom.

The inert gas can be in gaseous, liquid and/or solid form and selected from the group consisting of any well-known cryogenic inert gases such as nitrogen, argon, carbon dioxide, etcetera. Preferably, liquid nitrogen, e.g., as a spray, or carbon dioxide (pellets/snow) are used. According to a preferred embodiment of the invention, the elongated object, such as a wire, is further submitted to an annealing step. This annealing step is preferably carried out under an inert gas atmosphere, which atmosphere can comprise inert gas recovered from the previous embrittlement steps by exposure to a cold inert gas, preferably a cryogenic inert gas. This inert gas from the embrittlement step might be heated before injection in the location where annealing occurs, or directly injected from recovery.

DETAILED DESCRIPTION OF THE INVENTION

Figure 2:
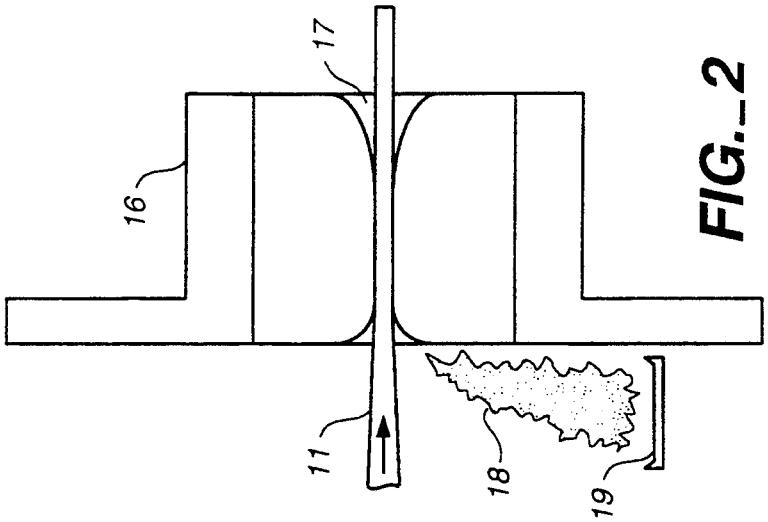
FIG. 2 is a cross-sectional illustration of the die used to remove surface contaminants from an elongated object.
Figure 1:
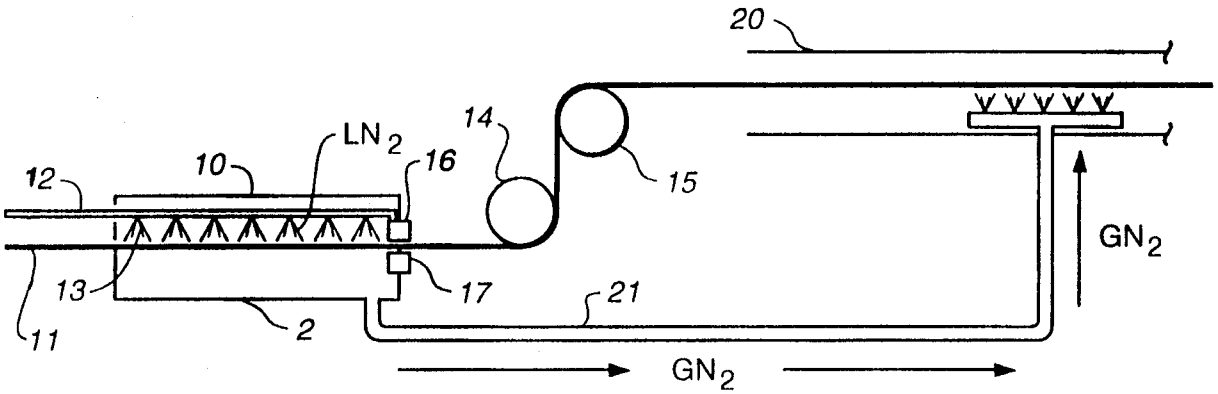
FIG. 1 is a schematic depiction of the device of the present invention.

The device of the present invention is shown schematically in FIG. 1. Specifically, elongated objects such as wire or rod 11 are fed into first chamber 10. Within first chamber 10 is provided a source of liquid or solid inert gas shown schematically by feed pipe 12 spraying the inert gas through nozzles 13 over the length of wire or rod 11.

Inert gas emanating from nozzles 13 is extremely cold. Suitable examples of the inert gas include liquid nitrogen and/or argon and carbon dioxide which, although stored in liquid form, becomes solid (snow pellets) upon introduction within first chamber 10, or cold gaseous nitrogen, argon or carbon dioxide.

The cold inert gas will embrittle virtually any contaminant coated on wire or rod 11. Typical contaminants include oxides, dirt, lubricant, lime, organic or inorganic matter including carbonaceous and graphite substances. According to the contaminants present on the surface of the elongated object, it might be useful to carry out at first some trials to determine whether it is more appropriate to use liquid inert gas such as liquid nitrogen, or argon, or carbon dioxide pellets/snow or a cold gaseous inert gas, in order to determine how embrittled the contaminants are after spraying with such different gases, and then choose the most appropriate one and the flow rate necessary for effective embrittlement of the surface.

Immediately upon exiting chamber 10, wire or rod 11 bearing its embrittled surface coating is drawn through die 16 by power/idler rollers, tension leveller 14, 15. Die 16 includes orifice 17 which is sized to allow the passage of only wire or rod 11 and not its surface coating. By virtue of the embrittlement of this coating, upon being subjected to die 16, the coating tends to flake off from wire or rod 11 as particulate matter 18 caught in a suitable receptacle 19 for disposal. As such, rod or wire 11, upon emanating from orifice 17, has been virtually cleaned of its surface contamination without use of any hazardous solvent cleaning, pickling or like solutions.

Figure 3:
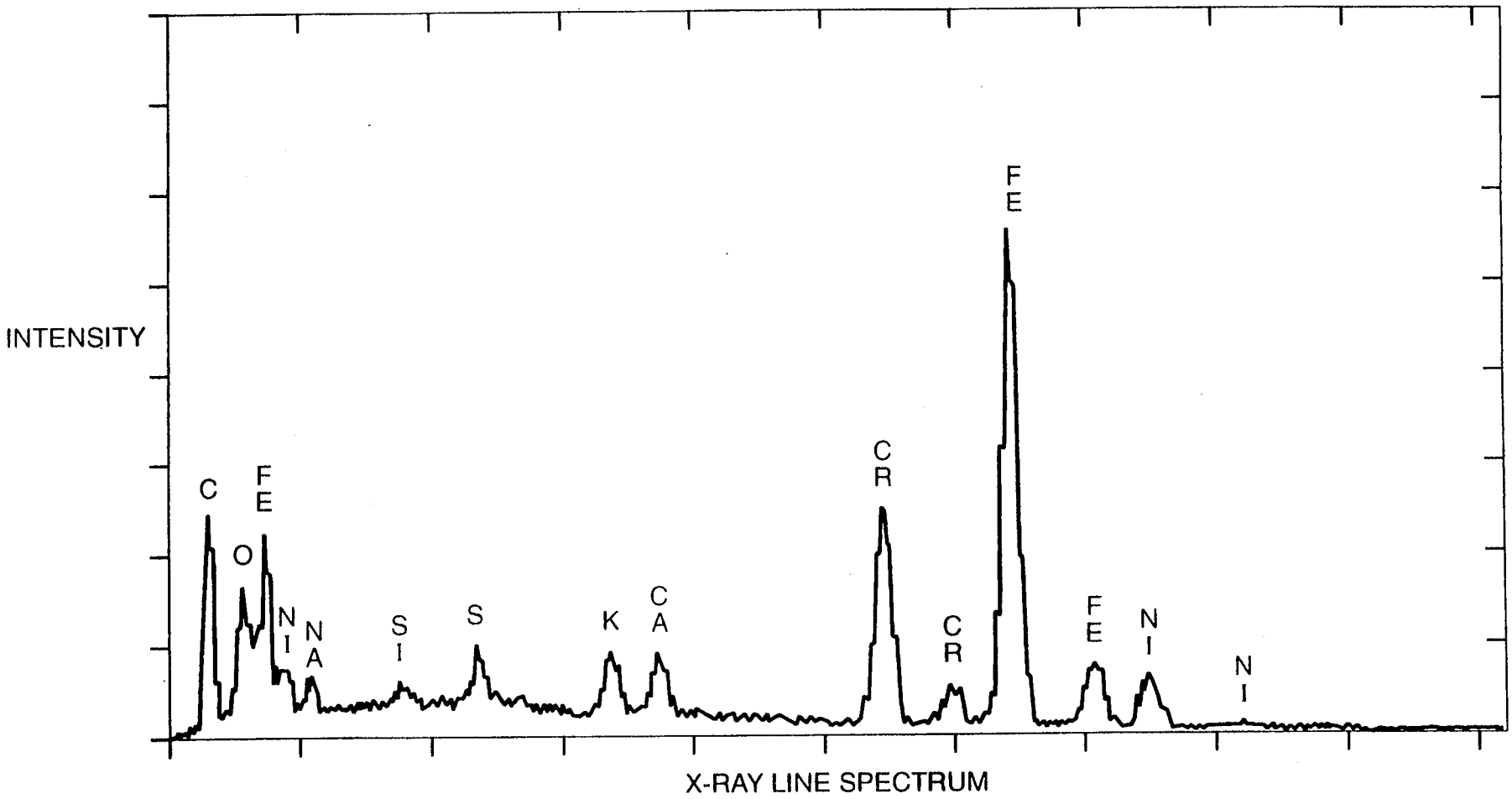
FIGS. 3 and 4 are drawings of SEM/EDX analysis of stainless steel wire comparing traditional prior art techniques with those of the present invention.

In reference to FIG. 3, there is shown a drawing of a scanning electron microscope/energy dispersive X-ray (SEM/EDX) analysis of a wire surface. FIG. 3 illustrates the relative intensity versus X-ray line spectrum for the various chemical elements found on the surface of the strand of wire traditionally found thereon prior to cleaning. Trace elements include calcium, potassium, carbon, sodium, etcetera.

Figure 4:
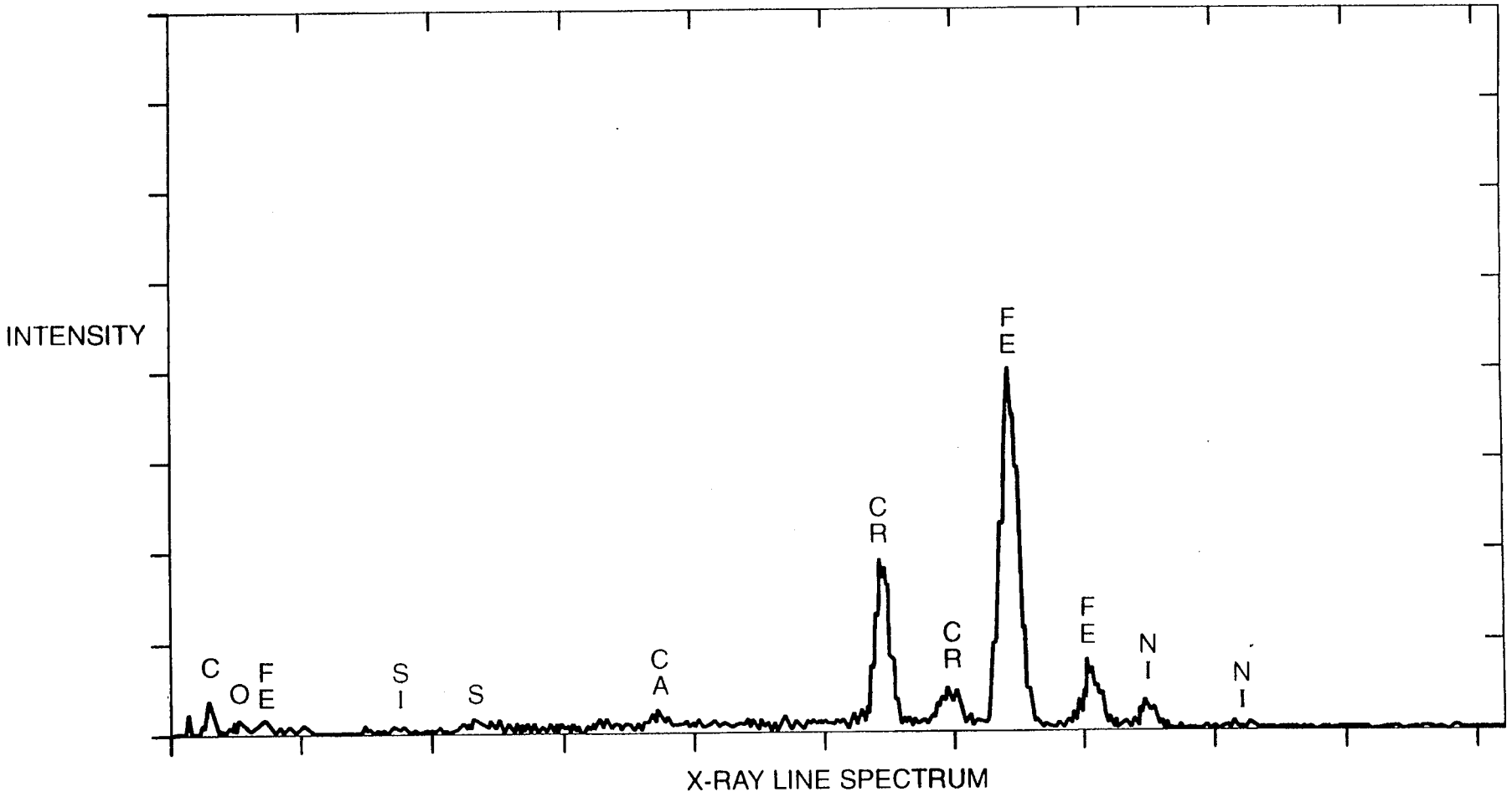

In comparison to FIG. 3, reference is made to FIG. 4 whereby the same wire was subjected to cleaning by embrittling surface contaminants with liquid nitrogen prior to drawing the wire through die 16. As noted, substantially all of the contaminants on the left-hand side of the drawings, such as C, Si, S, K, Ca, etc., have been removed as a result of the use of the device schematically depicted in FIG. 1.

It is contemplated as a preferred embodiment that the once cleaned rod or wire 11 be subjected to heat treating annealing. As such, heat treating annealing furnace 20 is provided for accepting rod or wire 11 as part of the overall inventive process disclosed herein.

In carrying out the annealing process, it is contemplated that an inert gas be introduced to the interior of furnace 20 and/or to the interior of a protective shroud located between the cold box/device apparatus and the furnace entrance. The purpose of this shroud is to maintain a dry atmosphere around the cold product on which water from air could condensate. In order to optimize the efficiency of the present system, it is contemplated that the inert gas fed to furnace 20 be the same gas introduced in liquid or solid form within first chamber 10. In reference to FIG. 1, feed line 21 can be employed to draw spent inert gas from first chamber 10 and introduce it to the interior of furnace 20 for carrying out heat treating annealing.

I claim:

1. A method of cleaning the surface of an elongated object selected from the group consisting of wires, rods, tube-shaped objects and flat-shaped objects or a combination thereof, in order to remove contaminants therefrom, said method comprising exposing said elongated object to a gaseous, liquid or solid inert gas or any combination thereof in an amount sufficient to substantially embrittle said contaminants whereupon said elongated object is drawn through an orifice causing the embrittled surface contaminants to be removed from said elongated object.

2. The method of claim 1, wherein said inert gas is selected from the group consisting of liquid nitrogen, liquid argon and solid carbon dioxide.

3. The method of claim 2, wherein said solid carbon dioxide is in the form of snow or pellets.

4. The method of claim 1, wherein said elongated object is further subjected to annealing after said contaminants have been removed therefrom.

5. The method of claim 4, wherein said annealing is carried out in an inert atmosphere.

6. The method of claim 5, wherein said inert atmosphere is established by using the inert gas recycled after exposure to said elongated object for embrittling said surface contaminants.

7. The method of claim 5, wherein said inert atmosphere is selected from the group consisting of nitrogen, argon and carbon dioxide.

8. The method of claim 1, wherein said orifice is a die orifice having substantially the same section as the elongated object section.

9. The method of claim 1, wherein said cleaning is effected without the need for solvents, acidic- or alkali-pickling solutions.

10. The method of claims 1, wherein said elongated object is a wire or rod.

11. The method of claim 1, wherein said contaminants are selected from the group consisting of organic and inorganic substances.

12. The method of claim 11, wherein said contaminants are selected from the group consisting of dirt, lubricants and carbonaceous substances.

13. The method of claim 11, wherein said contaminants are selected from the group consisting of inorganic compounds or elements.

* * * * *